US006371363B1

(12) United States Patent
Franklin et al.

(10) Patent No.: US 6,371,363 B1
(45) Date of Patent: Apr. 16, 2002

(54) BOTTOM STRUCTURE FOR COLLAPSIBLE CONTAINER

(75) Inventors: Troy M. Franklin, Princeton, LA (US); Donald E. Newcomer, Erie, PA (US)

(73) Assignee: Inland Paperboard and Packaging, Inc., Indianapolis, IN (US)

( * ) Notice: Subject to any disclaimer, the term of this patent is extended or adjusted under 35 U.S.C. 154(b) by 0 days.

(21) Appl. No.: 09/491,829

(22) Filed: Jan. 26, 2000

Related U.S. Application Data

(60) Provisional application No. 60/117,324, filed on Jan. 26, 1999.

(51) Int. Cl.[7] ..... B65D 5/36; B65D 5/08

(52) U.S. Cl. ..... 229/109; 229/117; 229/184

(58) Field of Search ..... 229/109, 138, 229/184, 117

(56) References Cited

U.S. PATENT DOCUMENTS 1,720,146 A 7/1929 Reese
2,826,350 A 3/1958 Marx
2,858,968 A 11/1958 Pellaton (List continued on next page.)

FOREIGN PATENT DOCUMENTS

FR 2574755 6/1986
GB 2 243 596 11/1991

*Primary Examiner*—Gary E. Elkins
(74) *Attorney, Agent, or Firm*—Barnes & Thornburg

(57) ABSTRACT

A collapsible container made of paperboard and particularly a bottom structure for a collapsible containers. More particularly, a relatively flat bottom structure for a rapid set-up, octagon-shaped bulk box. The container includes an eight-sided body and a floor positioned to lie in a bottom opening of the eight-sided body upon movement of the eight-sided body from a collapsed, flattened position to assume an expanded, opened position.

23 Claims, 3 Drawing Sheets

U.S. PATENT DOCUMENTS 2,934,254 A 4/1960 Ullger
3,083,889 A 4/1963 Christensson
3,101,167 A 8/1963 Styler
3,115,291 A 12/1963 Kotowick
3,132,791 A 5/1964 Haysler et al.
3,253,767 A * 5/1966 Pellaton ..... 229/184
3,344,971 A 10/1967 Walker
3,373,917 A 3/1968 Cox
3,525,466 A 8/1970 Robinson
3,561,667 A 2/1971 Saltman
3,565,235 A 2/1971 Brown et al.
3,642,192 A 2/1972 Wilcox, Jr. et al.
3,809,310 A 5/1974 VanderLugt, Jr.
3,877,631 A 4/1975 Lai et al.
3,907,194 A * 9/1975 Davenport et al. ..... 229/184
4,109,985 A 8/1978 Lieb, Jr.
4,131,228 A * 12/1978 Barry ..... 229/109
4,146,169 A 3/1979 Meyers et al.
4,166,567 A 9/1979 Beach, Jr. et al.
4,185,764 A 1/1980 Cote
4,199,098 A 4/1980 Lopez
4,243,171 A 1/1981 Prin
4,244,510 A 1/1981 Snyder et al.
4,260,100 A 4/1981 Hoffman
4,289,267 A 9/1981 Mayae
4,428,499 A 1/1984 Nauheimer
4,448,309 A 5/1984 Roccaforte et al.
4,453,665 A 6/1984 Roccaforte et al.
4,470,540 A 9/1984 Koltz
4,502,624 A * 3/1985 Burrell ..... 229/184
4,549,690 A 10/1985 Rosenburg
4,607,785 A 8/1986 Croley
4,676,429 A 6/1987 Crowe et al.
4,742,915 A 5/1988 Ringer
4,747,485 A 5/1988 Chaussadas
4,760,922 A 8/1988 Northgrave
4,767,051 A * 8/1988 Single ..... 229/117
4,834,255 A 5/1989 Boots
4,854,474 A 8/1989 Murray et al.
4,856,705 A 8/1989 Carr et al.
4,871,068 A 10/1989 Dreyfus
4,881,683 A 11/1989 Linnemann
4,917,289 A 4/1990 Linnemann et al.
5,040,721 A 8/1991 Essack
5,115,965 A 5/1992 Alepuz
5,295,623 A 3/1994 Bacques et al.
5,531,374 A 7/1996 Gasper
5,613,694 A 3/1997 Gasper
5,628,450 A * 5/1997 Cromwell et al. ..... 229/109
5,630,543 A 5/1997 Dugan
5,715,991 A 2/1998 Gasper
5,816,483 A 10/1998 Gasper

* cited by examiner

BOTTOM STRUCTURE FOR COLLAPSIBLE CONTAINER

This application claims priority under 35 U.S.C. 119(e) to U.S. Provisional Application Ser. No. 60/117,324, filed Jan. 26, 1999, which is expressly incorporated by reference herein.

BACKGROUND AND SUMMARY OF THE INVENTION

The present invention relates to collapsible containers, and particularly to bottom structures for collapsible containers made of paperboard. More particularly, the present invention relates to a relatively flat bottom structure for a rapid set-up, octagon-shaped bulk box.

Bulk boxes are containers that are used to store bulk resins, food products, or other items. One problem with many bulk boxes is that it is necessary to fold the bottom flaps manually to create a box floor at the time the box is set up. Additional labor is needed to create a box floor at the time the box is set up. Manual floor setup is a problem for rectangular and octagonal bulk boxes.

According to the present invention, a container includes an eight-sided body and a floor positioned to lie in a bottom opening of the eight-sided body upon movement of the eight-sided body from a collapsed, flattened position to assume an expanded, opened position. The floor includes first, second, third, and fourth bottom flaps and flap connectors.

The first, second, third, and fourth bottom flaps are coupled at flap fold lines to first, third, fifth, and seventh walls, respectively, in the set of eight walls in the eight-sided body. The first, second, third, and fourth flap connectors are coupled at connector fold lines to second, fourth, sixth, and eighth walls, respectively, in the set of eight walls in the eight-sided body. Each flap connector is coupled to each of the adjacent bottom flaps along fold lines so that the bottom flaps and flap connectors move relative to one another and to the eight walls of the eight-sided body to establish the floor automatically as the eight-sided body is moved from the collapsed, flattened position to assume the expanded, opened position.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the following figures in which:

FIG. 5 is a perspective view showing application of a force to each of two corners of the container sleeve of FIG. 4 during an initial stage of sleeve expansion and showing pivoting movement of each bottom flap relative to its companion appendant side wall and movement of each of the four flap connectors relative to the flanking bottom flaps coupled thereto;

FIG. 6 is a perspective view similar to FIG. 5 showing farther folding of the eight side walls, four bottom flaps, and four flap connectors during a later stage of sleeve expansion;

FIG. 7 is a perspective view similar to FIG. 6 showing formation of the container floor upon set-up of the container.

DETAILED DESCRIPTION OF THE DRAWINGS

Figure 1:
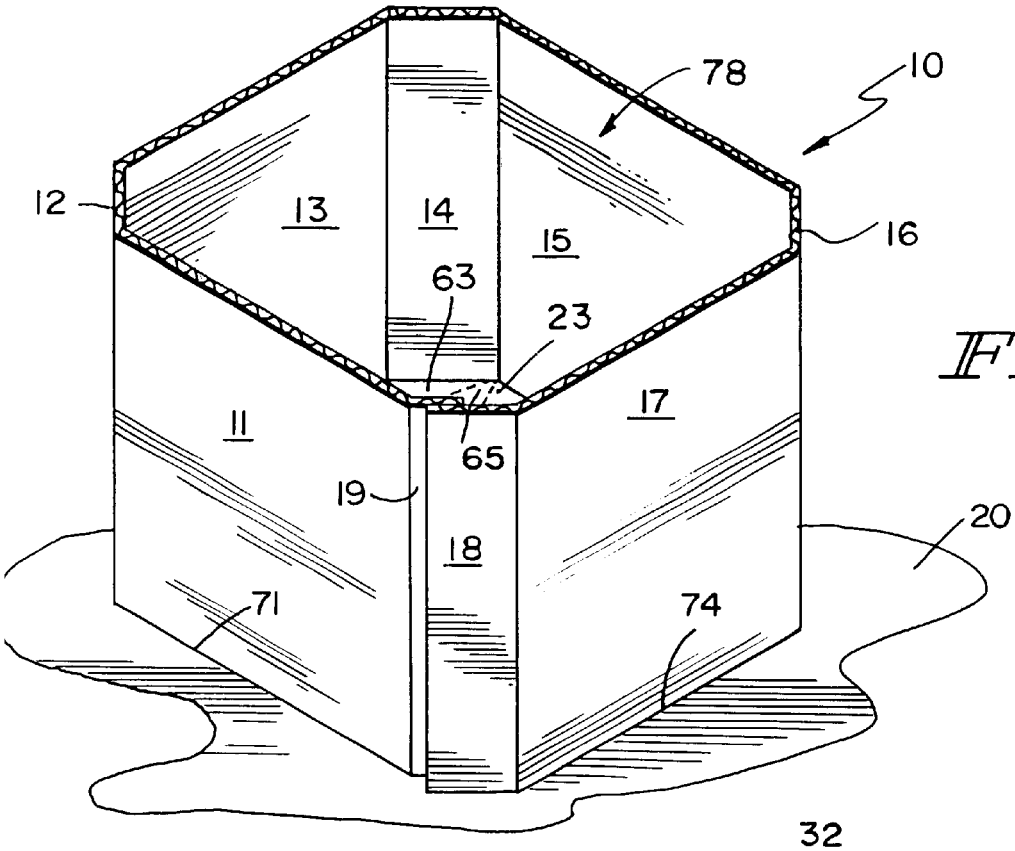
FIG. 1 is a perspective view of an erected container in accordance with the present invention showing vertical side walls included in the container and a somewhat octagon-shaped top opening defined by upper edges of the container side walls.

A collapsible container 10 having eight side walls and a foldable bottom structure is shown setting on a flat surface 20 in FIG. 1. It is within the scope of this disclosure to adhere a multi-wall inner panel (not shown) to an inwardly facing surface of the eight side walls in container 10 to rigidify container 10.

Figure 2:
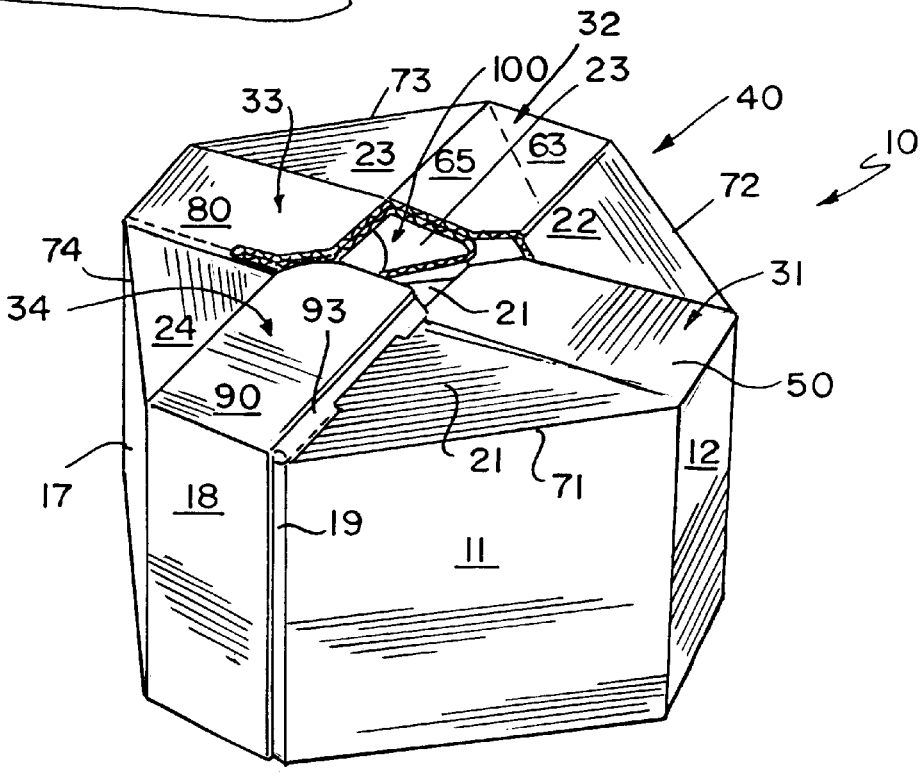
FIG. 2 is a perspective view of the container of FIG. 1 (after it has been inverted) showing an arrangement of bottom flaps and flap connectors that cooperate to form the floor of the container.

As shown, for example, in FIGS. 1 and 2, container 10 includes first wall 11, second wall 12, third wall 13, fourth wall 14, fifth wall 15, sixth wall 16, seventh wall 17, eighth wall 18, and a connection flange 19 appended to first wall 11 and arranged to be coupled to eighth wall 18. Container 10 also includes a set of four bottom flaps 21, 22, 23, and 24 and a set of four flap connectors 31, 32, 33, and 34 that are appended to the eight walls 11–18 (as shown, for example, in FIG. 3), which sets cooperate to define a container floor 40 once container 10 has been set up (as shown, for example, in FIGS. 5–7).

Figure 3:
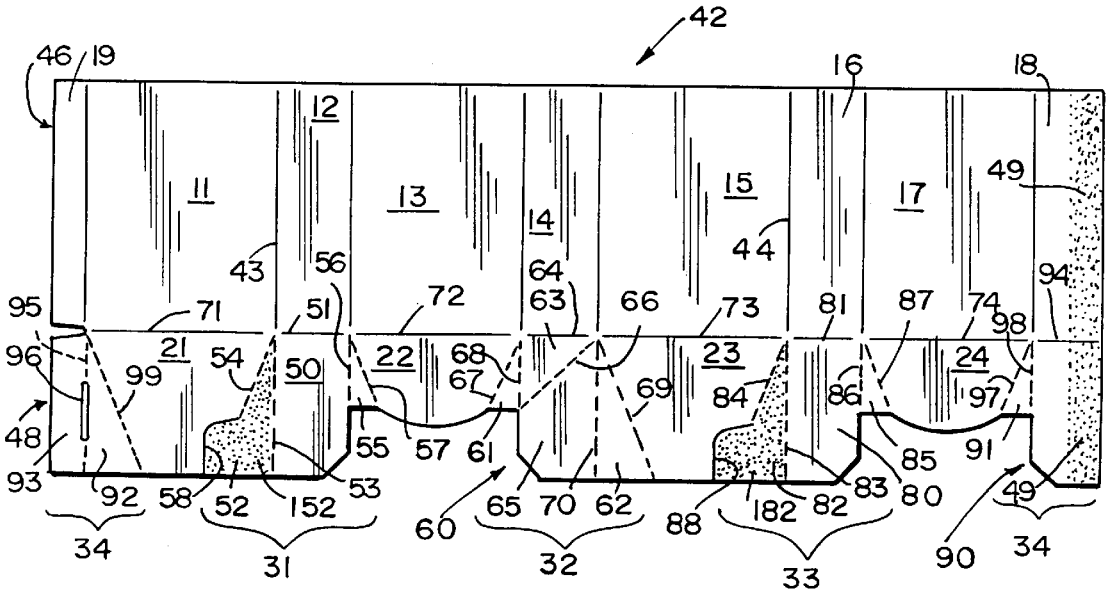
FIG. 3 is a plan view of an inside wall of a blank used to make the container of FIGS. 1 and 2 showing an upper strip comprising eight side walls and a left-side connection flange and a lower strip comprising a series of bottom flaps and flap connectors that can be arranged and folded as shown in FIGS. 4–8 to produce a relatively flat floor of in the container of FIGS. 1 and 2.

Container 10 is formed from a die-cut blank 42 made of a paperboard such as a corrugated material and shown, for example, in FIG. 3. Blank 42 can be folded along fold lines 43 and 44 and connector flange 19 can be coupled to eighth wall 18 to provide a container sleeve 45 as shown, for example, in FIG. 4. Bottom flaps 21–24 and flap connectors 31–34 cooperate to define container floor 40 once container sleeve 45 is expanded and manipulated as shown, for example, in FIGS. 4–7.

Blank 42 includes an upper strip 46 comprising (in series) flange connector 19, first wall 11, second wall 12, third wall 13, fourth wall 14, fifth wall 15, sixth wall 16, seventh wall 17, and eighth wall 18. Blank 42 also includes a lower strip 48 comprising (in series) a first portion of fourth flap connector 34, first bottom flap 21, first flap connector 31, second bottom flap 22, second flap connector 32, third bottom flap 23, third flap connector 33, fourth bottom flap 24, and a second portion of fourth flap connector 34. An upper edge of lower strip 48 is appended to a lower edge of upper strip 46 along a series of fold lines 71, 51, 72, 64, 73, 81, 74, and 94 as shown, for example, in FIG. 3.

Figure 4:
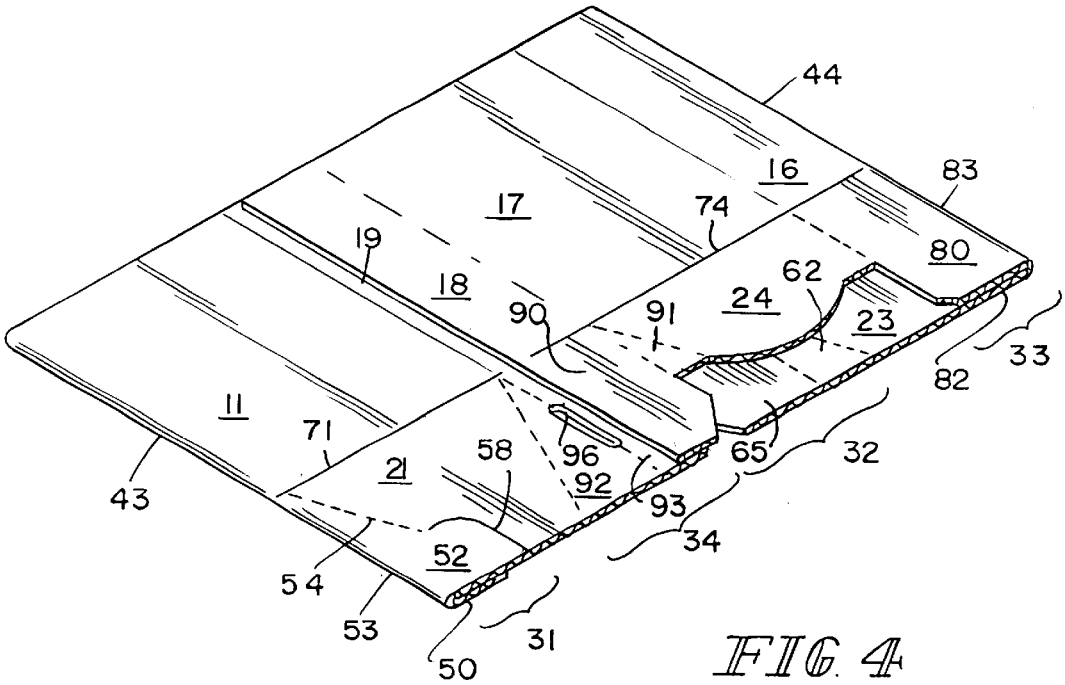
FIG. 4 is a perspective view of the blank of FIG. 3 after it has been partly assembled to define a container sleeve and before manipulation of the side walls, bottom flaps, and flap connectors to form the floor of the container.

The first and second portions of fourth flap connector 34 are configured to be coupled to one another when flange connector 19 is coupled to eighth wall 18 to produce container sleeve 45 as shown, for example, in FIG. 4. As shown in FIG. 3, adhesive 49 can be applied to an "edge surface" on eighth wall 18 and an "edge surface" on the second portion of fourth flap connector 34 to facilitate such coupling to produce container sleeve 45.

As shown best in FIG. 3, each of first and third bottom flaps 21, 23 has a first shape characterized by a long base edge appendant to one of the container walls 11 or 15, a relatively short outer edge arranged to lie in parallel relation to the base edge, long and short diagonal side edges, and a somewhat L-shaped curving side edge interconnecting the outer edge and the short diagonal side edge. Each of the second and fourth bottom flaps 22, 24 has a somewhat trapezoidal second shape characterized by a long base edge appendant to one of the container walls 13 or 17, a relatively short bowed outer edge arranged to lie in spaced-apart relation to the straight base edge, and a pair of diagonal side edges arranged to interconnect the base and outer edges and converge in a direction extending away from the container walls 13, 17 as shown, for example, in FIG. 3.

As shown in FIG. 3, the shape of first flap connector 31 is the same as the shape of third flap connector 33. Also, the shape of second flap connector 32 will match the shape of fourth flap connector 34 once the first and second portions of fourth flap connector 34 are coupled to one another. Each of the flap connectors 31–34 will be described in more detail-herein with reference to FIGS. 3 and 4.

Figure 5:
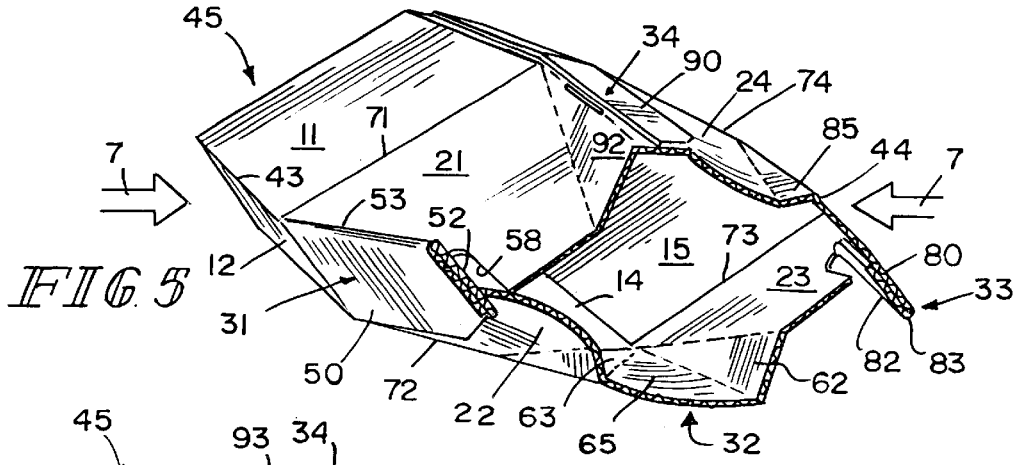
FIGS. 5–7 show a sequence wherein various external forces are applied to the container sleeve shown in FIG. 4 to expand the container sleeve from a collapsed, flattened position to an upright, opened, set-up position.
Figure 6:
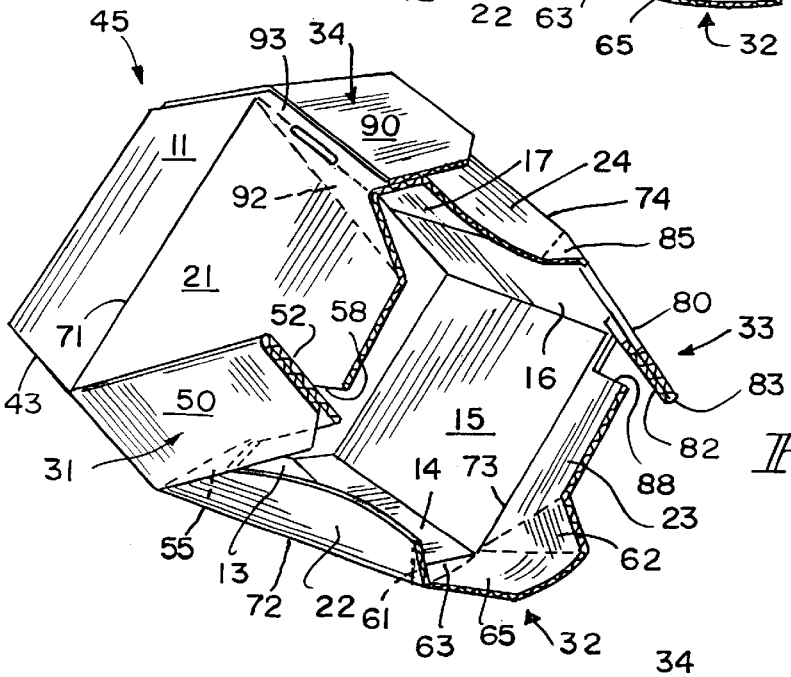

First flap connector 31 is coupled to first and second bottom flaps 21, 22 and second wall 12 as shown in FIG. 3. First flap connector 31 includes a center section 50 coupled to second wall 12 along first connector fold line 51, a large left side section 52 coupled to center section 50 along serrated fold line 53 and coupled to the short diagonal side edge of first bottom flap 21 along serrated fold line 54, and a small right side section 55 coupled to center section 50 along serrated fold line 56 and coupled to one of the diagonal side edges of second bottom flap 22 along serrated fold line 57. First flap connector 31 is separated from first bottom flap 21 along a somewhat L-shaped cut line 58 to enable movement of first flap connector 31 relative to first bottom flap 21 during setup of container 10 as shown, for example, in FIGS. 5 and 6. Third flap connector 33 is similar to first flap connector 31 as described herein. Adhesive 152 is applied to one face of large side section 52 as shown, for example, in FIG. 3 to adhere that face to a companion face on center section 50 to mate sections 50, 52 to one another as shown, for example, in FIGS. 4–6. Once so mated, sections 50, 52 are arranged to lie in side-by-side fixed relation to one another as shown in FIGS. 4–6.

Second flap connector 32 is coupled to second and third bottom flaps 22, 23 and fourth wall 14 as shown in FIG. 3. Second flap connector 32 includes a center section 60, a small left side section 61 positioned to lie between second bottom flap 22 and center section 60, and a large right side section 62 positioned to lie between center section 60 and third bottom flap 23. Center section 60 includes a first portion 63 coupled to fourth wall 14 along a second connector fold line 64 and a second portion 65 coupled to first portion 63 along serrated fold line 66 to position first portion 63 between fourth wall 14 and second portion 65. First portion 63 has a triangular shape and second portion 65 has a quadrilateral shape. Small side section 61 is coupled to second bottom flap 22 along serrated fold line 67 and to first portion 63 of center section 60 along serrated fold line 68. Large side section 62 is coupled to third bottom flap 23 along serrated fold line 69 and to second portion 65 of center section 60 along serrated fold line 70.

Third flap connector 33 matches first flap connector 31 in size, shape, and construction and is coupled to third and fourth bottom flaps 23, 24 and sixth side wall 16 as shown in FIG. 3. Third flap connector 33 includes a center section 80 coupled to sixth wall 16 along third connector fold line 81, a large left side section 82 coupled to center section 80 along serrated fold line 83 and coupled to the short diagonal side edge of third bottom flap 23 along serrated fold line 84, and a small right side section 85 coupled to center section 80 along serrated fold line 86 and coupled to one of the diagonal side edges of fourth bottom flap 24 along serrated fold line 87. Third flap connector 33 is separated from third bottom flap 23 along a somewhat L-shaped cut line 88 to enable movement of third flap connector 33 relative to third bottom flap 23 during setup of container 10 as shown, for example, in FIGS. 5 and 6. Adhesive 182 is applied to one face of large side section 82 as shown, for example, in FIG. 3 to adhere that face to a companion face on center section 80 to mate sections 80, 82 to one another as shown, fo example, in FIGS. 4–6. Once so mated, sections 80, 82 are arranged to lie in side-by-side relation to one another as shown in FIGS. 4–6.

Fourth flap connector 34 includes a first portion coupled to first bottom flap 21 and a second portion coupled to fourth bottom flap 24 as shown in FIG. 3. The second portion of fourth flap connector 34 lies at the right end of lower strip 48 and includes a center section 90 and a small left side section 91 positioned to lie between fourth bottom flap 24 and center section 90. The first portion of fourth flap connector 34 lies at the left end of lower strip 48 and includes a large right side section 92 and a flange connector 93 arranged to position large side section 92 between flange connector 93 and first bottom flap 21. Center section 90 is coupled to eighth wall 18 along fold line 94. Small side section 91 is coupled to fourth bottom flap 24 along serrated fold line 97 and to center section 90 along serrated fold line 98. Large side section 92 is coupled to first bottom flap 21 along serrated fold line 99 and to flange connector 93 along serrated fold line 95. The first portion of fourth flap connector 34 is formed to include an elongated slot 96 arranged to extend along serrated fold line 95 as shown, for example, in FIG. 3. Adhesive 49 is applied to an edge surface on center section 90 to enable connector flange 93 to be coupled to center section 90 to produce container sleeve 45 as shown in FIGS. 3 and 4.

In a preferred embodiment, the included angle between each of the following pairs of fold lines (95, 99), (54, 53), (56, 57), (67, 68), (70, 69), (84, 83), (86, 87), and (97, 98) is 22.5 degrees. The illustration of blank 42 in FIG. 3 is a scale drawing. The corrugation direction is vertical.

During a first stage of container construction, container sleeve 45 is formed by manipulating paperboard blank 42 in the following manner. First wall 11 is folded about fold line 43 to overlie second wall 12 and a portion of third wall 13 as shown in FIG. 4. Sixth wall 16 is folded about fold line 44 to cause sixth, seventh, and eighth walls 16, 17, and 18 to overlie third, fourth, and fifth walls 13, 14, and 15. Flange connector 19 on upper strip 46 of blank 42 is bonded to adhesive 49 on eighth wall 18 and flange connector 93 on lower strip 48 of blank 42 is bonded to adhesive 49 on center section 90 of fourth flap connector 34 to establish container sleeve 45 as shown, for example, in FIG. 4. It is within the scope of this disclosure to use staples or any other suitable connector(s) in lieu of adhesive 49, 152, or 182.

Figure 7:
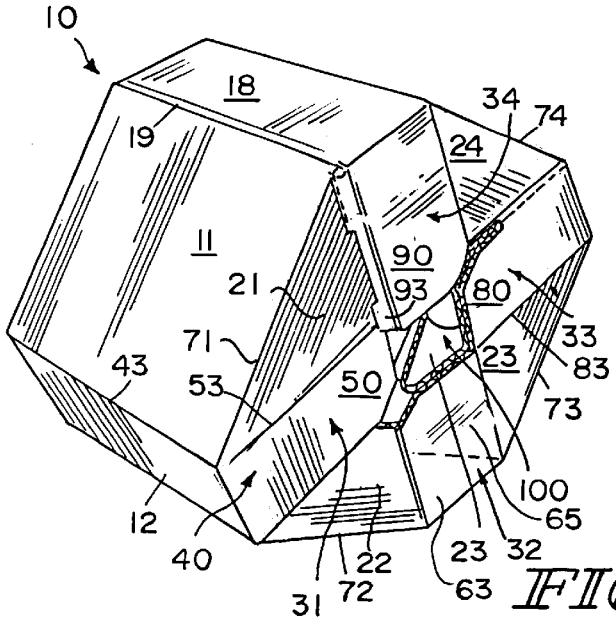

External force 75 is then applied to a "corner" of container sleeve 45 (at, for example, fold line 43) and, at the same time, external force 76 is applied to a "corner" of container sleeve 45 (at, for example, fold line 44) as shown diagrammatically in FIG. 5. Sleeve 45 is expanded as shown in FIGS. 5–7 to cause bottom flaps 21, 22, 23, and 24 to fold relative to side walls 11, 13, 15, and 17 about hinges (e.g., flap fold lines) 71, 72, 73, and 74, while center sections 50, 60, 80, and 90 of flap connectors 31, 32, 33, and 34 fold relative to side walls 12, 14, 16, and 18 about hinges (e.g., connector fold lines) 51, 64, 81, and 94. During such expansion, the multi-part flap connectors 31, 32, 33, and 34 move relative to the bottom flaps 21, 22, 23, and 24 to establish container floor 40 automatically. If desired, a container liner (not shown) of any suitable construction can be placed in the interior region 78 of container 10 and a lid (not shown) can be used to cover the open mouth of interior region 78.

Figure 8:
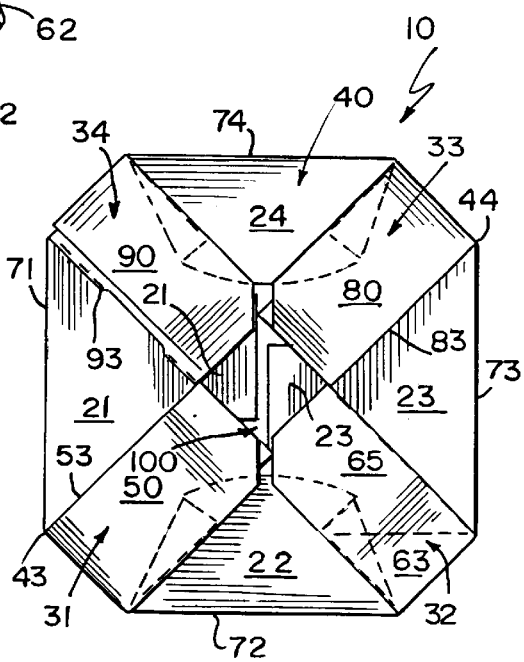
FIG. 8 is a bottom view of the container of FIG. 7 showing portions of the four bottom flaps at about "12, 3, 6, and 9 o'clock" positions on the container floor and portions of the four flap connectors at about "1, 4, 7, and 11 o'clock" positions on the container floor.

As shown best in FIGS. 2, 7, and 8, first, second, third, and fourth flap connectors 31, 32, 33, and 34 overlie first, second, third, and fourth bottom flaps 21, 22, 23, and 24 and cooperate to form a plus-shaped pattern on an exterior surface of container floor 40 upon movement of sleeve 45 to cause container 10 to assume the expanded, opened position. Each of the first, second, third, and fourth flap connectors 31, 32, 33, 34 includes a free end and the free ends cooperate to define a square-shaped aperture 100 therebetween once the container 10 is moved to assume the expanded, opened position. First and third flaps 21, and 23 include free ends that cooperate to close square-shaped aperture 100 once container 10 is erected. Flap connectors 31, 32, 33, 34 also cooperate to cover portions of first, second, third, and fourth bottom flaps 21, 22, 23, and 24 as shown in FIGS. 2, 7, and 8, to leave triangle-shaped portions of those bottom flaps visible on the exterior surface of floor 40 once container 10 is erected.

Although the invention has been described in detail with reference to preferred embodiments, variations and modifications exist within the scope and spirit of the invention as described and defined in the following claims.

What is claimed is:

1. A container comprising an eight-sided body formed to include a top opening and a bottom opening and configured to be folded from an expanded, opened position to a collapsed, flattened position, the eight-sided body including a set of eight walls arranged consecutively in a series to provide the eight-sided body with an octagon shape upon movement of the eight-sided body to assume the expanded, opened position, and a floor positioned to lie in the bottom opening of the eight-sided body upon movement of the eight-sided body to assume the expanded, opened position, the floor including first, second, third, and fourth bottom flaps and first, second, third, and fourth flap connectors, each of the bottom flaps and flap connectors being coupled to one of the eight walls, wherein the first bottom flap is coupled to a first wall in the set of eight walls at a first flap fold line, the first flap connector is coupled to a second wall in the set of eight walls at a first connector fold line, the second bottom flap is coupled to a third wall in the set of eight walls at a second flap fold line, the second flap connector is coupled to a fourth wall in the set of eight walls at a second connector fold line, the third bottom flap is coupled to a fifth wall in the set of eight walls at a third flap fold line, the third flap connector is coupled to a sixth wall in the set of eight walls at a third connector fold line, the fourth bottom flap is coupled to a seventh wall in the set of eight walls at a fourth flap fold line, and the fourth flap connector is coupled to an eighth wall in the set of eight walls at a fourth connector fold line, the first flap connector includes a first center section coupled to the second wall at the first connector fold line, a first right side section coupled to the first center section at a fold line and to the second bottom flap at a fold line, and a first left side section coupled to the first center section at a fold line and to the first bottom flap at a fold line, the first left side section being larger than the first right side section, the second flap connector includes a second center section coupled to the fourth wall at the second connector fold line, a second right side section coupled to the second center section at a fold line and to the third bottom flap at a fold line, and a second left side section coupled to the second center section at a fold line and to the second bottom flap at a fold line, the third flap connector includes a third center section coupled to the sixth wall at the third connector fold line, a third right side section coupled to the third center section at a fold line and to the fourth bottom flap at a fold line, and a third left side section coupled to the third center section at a fold line and to the third bottom flap at a fold line, and the fourth flap connector includes a fourth center section coupled to the eighth wall at the fourth connector fold line, a fourth right side section coupled to a flange connector at a fold line and to the first bottom flap at a fold line, and a fourth left side section coupled to the fourth center section at a fold line and to the fourth bottom flap at a fold line.

2. The container of claim 1, wherein each of the first and third bottom flaps has a first shape characterized by a long base edge appendant to one of the first and fifth walls, a short outer edge arranged to lie in parallel relation to the long base edge, long and short diagonal side edges defining fold lines, and an L-shaped curving side edge interconnecting the short outer edge and the short diagonal side edge.

3. The container of claim 2, wherein each of the second and fourth bottom flaps is characterized by a long base edge appendant to one of the third and seventh walls, a short bowed outer edge arranged to lie in spaced-apart relation to the long base edge, and a pair of diagonal side edges arranged to interconnect the long base edge and the short bowed outer edge and converge in a direction extending away from said one of the third and seventh walls.

4. The container of claim 1, wherein each of the second and fourth bottom flaps is characterized by a long base edge appendant to one of the third and seventh walls, a short bowed outer edge arranged to lie in spaced-apart relation to the long base edge, and a pair of diagonal side edges arranged to interconnect the long base edge and the short bowed outer edge and converge in a direction extending away from said one of the third and seventh walls.

5. The container of claim 1, wherein a flange connector is coupled to the fourth right side section, the fourth center section is coupled to the fourth left side section, and the flange connector is coupled to the fourth center section.

6. The container of claim 5, wherein the fourth flap connecter is formed to include an elongated slot positioned to lie along the fold line located between the flange connector and the fourth right side section.

7. The container of claim 1, wherein a face of the first left side section is adhered to a face of the first center section to fix the first left side and first center sections in side-by-side relation to one another.

8. The container of claim 7, wherein the first left side section is larger than the first right side section.

9. The container of claim 7, wherein the first right side section is triangle-shaped.

10. The container of claim 7, wherein a face of the third left side section is adhered to a face of the third center section to fix the third left side and third center sections in side-by-side relation to one another.

11. The container of claim 1, wherein the second right side section is smaller than the first left side section.

12. The container of claim 11, wherein the fourth right side section is larger than the fourth left side section.

13. The container of claim 1, wherein each of the second right and left side sections is triangle-shaped.

14. The container of claim 13, wherein each of the fourth right and left side sections is triangle-shaped.

15. The container of claim 1, wherein the second center section includes a first portion coupled to the fourth wall at the second connector fold line, a second portion coupled to the first portion along a fold line to position the first portion between the fourth wall and the second portion, the first portion has a triangular shape, and the second portion has a quadrilateral shape.

16. The container of claim 1, wherein the second left side section is smaller than the second right side section.

17. The container of claim 1, wherein the third left side section is larger than the third right side section.

18. The container of claim 1, wherein the fourth left side section is smaller than the fourth right side section.

19. A container comprising an eight-sided body formed to include a top opening and a bottom opening and configured to be folded from an expanded, opened position to a collapsed, flattened position, the eight-sided body including a set of eight walls arranged consecutively in a series to provide the eight-sided body with an octagon shape upon movement of the eight-sided body to assume the expanded, opened position, and a floor positioned to lie in the bottom opening of the eight-sided body upon movement of the eight-sided body to assume the expanded, opened position, the floor including first, second, third, and fourth bottom flaps and first, second, third, and fourth flap connectors, each of the bottom flaps and flap connectors being coupled to one of the eight walls, wherein the first, second, third, and fourth flap connectors overlie the bottom flaps and cooperate to form a plus-shaped pattern with an aperture at the center on an exterior surface of the floor upon movement of the eight-sided body to assume the expanded, opened position.

20. The container of claim 19, wherein each of the first, second, third, and fourth flap connectors includes a free end and the free ends cooperate to define a square-shaped aperture therebetween upon movement of the eight-sided body to assume the expanded, opened position.

21. The container of claim 20, wherein the first and third bottom flaps include free ends that cooperate to close the square-shaped aperture upon movement of the eight-sided body to assume the expanded, opened position.

22. The container of claim 19, wherein the first, second, third, and fourth flap connectors cover portions of the first, second, third, and fourth bottom flaps to leave four triangle-shaped portions of the bottom flaps visible on the exterior surface of the floor upon movement of the eight-sided body to assume the expanded, opened position.

23. A container comprising an eight-sided body formed to include a top opening and a bottom opening and configured to be folded from an expanded, opened position to a collapsed, flattened position, the eight-sided body including a set of eight walls arranged consecutively in a series to provide the eight-sided body with an octagon shape upon movement of the eight-sided body to assume the expanded, opened position, and a floor positioned to lie in the bottom opening of the eight-sided body upon movement of the eight-sided body to assume the expanded, opened position, the floor including first, second, third, and fourth bottom flaps and first, second, third, and fourth flap connectors, each of the bottom flaps and flap connectors being coupled to one of the eight walls, wherein each of the second and fourth flap connectors includes a center section, a small side section positioned to lie between and pivot relative to the center section and one of the bottom flaps, and a large side section positioned to lie between and pivot relative to the center section and another of the bottom flaps, and each of the side sections is a right triangle.

* * * * *